US005104122A

United States Patent [19]

Gossman

[11] Patent Number: 5,104,122

[45] Date of Patent: Apr. 14, 1992

[54] MEANS AND METHOD FOR CONDITIONING AND MAINTAINING A POOL CUE TIP

[76] Inventor: David L. Gossman, R.R. 1, Box 176, Milford, Iowa 51351

[21] Appl. No.: 684,058

[22] Filed: Apr. 11, 1991

[51] Int. Cl.[5] ..... A63D 15/16

[52] U.S. Cl. ..... 273/18; 273/17

[58] Field of Search ..... 273/17, 18, 19, 20, 273/21, 14

[56] References Cited

U.S. PATENT DOCUMENTS

| | | | |
|---|---|---|---|
| 1,121,560 | 12/1914 | Hobbs | 273/20 |
| 2,489,464 | 11/1949 | Roland | 273/20 |
| 5,046,728 | 9/1991 | Haddock | 273/18 |

FOREIGN PATENT DOCUMENTS

| | | | |
|---|---|---|---|
| 493974 | 2/1930 | Fed. Rep. of Germany | 273/18 |
| 799542 | 6/1936 | France | 273/17 |
| 200657 | 7/1923 | United Kingdom | 273/17 |

*Primary Examiner*—Theatrice Brown

*Attorney, Agent, or Firm*—Zarley, McKee, Thomte, Voorhees & Seas

[57] ABSTRACT

A tool and method for conditioning and maintaining a pool cue tip includes a unitary body member. An abrasive material for sanding and trimming the side wall of the tip is positioned on the body. A member for burnishing the side wall of the tip is also positioned on the body. One or more cavities including abrasive is also included on the body as well as teeth for perforating the tip. The method includes trimming and burnishing the side wall, as well as shaping and perforating the cue tip surface.

10 Claims, 2 Drawing Sheets

MEANS AND METHOD FOR CONDITIONING AND MAINTAINING A POOL CUE TIP

BACKGROUND OF THE INVENTION a. Field of the Invention

The present invention relates to pool cues and pool cue tips, and in particular, to means and methods for conditioning and maintaining a pool cue tip.

b. Problems in the Art

The age-old game of pool or billiards continues to be popular today. In fact, there appears to have been a resurgence in growth of active participants of the game. Millions of people enjoy the sport across the world.

Pool players exhibit various skill levels from novice to expert. In every case, however, performance is affected by the condition of the player's pool cue. Even the most expert player will not be able to rely on a cue which either has a bent or bowed cue shaft, or a worn, damaged, deformed, or poorly conditioned cue tip.

Conventional pool cues have an elongated shaft. The shaft is generally made of wood; either in a single piece or multiple pieces which can be fitted together for playing and then disassembled for transport or storage. Other materials, such as composites (for example, graphite composites) can also be used for the shaft.

The pool cue tip generally is held directly to the end of the cue shaft by an adhesive. A ferrule, which comprises an annular tubular piece, surrounds the end of the pool cue shaft to prevent the end from splitting. The leather tip piece is about ¼" thick and serves as the portion of the pool cue which strikes the pool or billiard balls.

This leather piece extends beyond the ferrule so that it can be used to strike balls head on, but also, if desired, can strike balls on or around its sides or edges. The leather material presents a somewhat resilient buffer material between the ball and the shaft, and also presents enough friction or adherence to the pool cue ball surface to allow the ball to be spun to an extent.

As previously stated, the condition of the leather tip is critical to optimal performance. Generally, the tip in ideal condition would have a slightly convex top surface with its annular side wall being slightly tapered from the top surface down to the ferrule. A rough gauge for the amount of curve of the top surface is to place a nickel or quarter so that its perimeter edge roughly matches the convex curve of the top surface of the leather tip.

If the tip becomes rounded substantially past this ideal convex shape, a reliable striking area for the top surface of the tip is diminished. This can result in problems with reliability and accuracy and shot making.

If the leather tip becomes flattened, its resilience and adherence is generally diminished, as is the ability to strike a pool ball off center to provide english or spinning to the pool ball. When flattened, the leather tip also generally becomes hard and smooth, losing its tackiness.

It is therefore a major problem to maintain the leather tip in sufficient shape for accurate and reliable pool playing. Still further, it is to be understood that it is conventional to apply chalk to the leather tip. The purpose of the chalk is to assist in keeping the leather tip tacky and have an increased coefficient of friction with pool balls, in the sense that it can apply english to pool balls. It is therefore important, in the maintenance of the cue tip, to prepare the tip so that is receives and retains a sufficient amount of chalk. If the leather is flattened and smoothed, its ability to retain chalk is diminished.

Presently, there is no known efficient and economical system for individual pool players to adequately maintain cue tips. A variety of methods and systems are used by individual enthusiasts, and owners and operators of establishments having pool tables to maintain cue tips, but no integrated, inexpensive, and comprehensive system is known.

Attempts have been made at producing pocket-sized pieces having abrasives which can be used to grind or sand a cue tip. However, these devices rely heavily on manual dexterity of the user to correctly estimate and then shape the cue. These devices also do not address the problem of maintaining the sides of the leather tip, or assisting in conditioning the leather to hold chalk.

A real need therefore exists in the art for a means and method for conditioning and maintaining pool cue tips. The need exists for both novices and experts, and those of skill levels in between. The need also exists for establishments providing pool tables or home users.

It is therefore a primary object of the present invention to provide a means and method of conditioning and maintaining pool cue tips which solves or improves over the problems and deficiencies in the art.

A further object of the present invention is to provide a means and method as above described which efficiently and comprehensively allows the conditioning and maintenance of the cue tip.

A still further object of the present invention is to provide a means and method as above described which is easily portable, lightweight, and durable.

Another object of the present invention is to provide a means and method as above described which allows individual or multiple functions for conditioning and maintaining a pool cue tip.

A still further object of the present invention is to provide a means and method as above described which is easy to use, attractive, and versatile.

Another object of the present invention is to provide a means and method as above described which pertains to maintenance and conditioning of not only the top of the pool cue tip, but also its sides.

A still further object of the present invention is to provide a means and method as above described which not only relates to shaping of the pool cue tip, but also to conditioning it to better hold chalk.

Another object of the present invention is to provide a means and method as above described which assists in the accurate conditioning and shaping of the tip while deterring erroneous shaping, conditioning or maintenance of the tip.

A further object of the present invention is to provide a means and method as above described which is economical to manufacture, as well as being economical to consumers.

These and other objects, features and advantages of the invention will become more apparent with reference to the accompanying specification and claims.

SUMMARY OF THE INVENTION

The means of the invention includes a one-piece body member. The body member is generally of a size which can be easily portable, and is preferably small enough to be held in one hand and carried in a pocket. The body member includes at least the following features. It has one or more abrasive portions that can be used to shape or scuff the leather cue tip surface. It also has a tooth member which can be used to perforate the leather tip to encourage it to retain chalk. It includes a rounded elongated groove or channel having one portion of abrasive material, with the remainder of the channel smooth. The smooth part of the channel serves as a holder and guide for rotation of the pool cue shaft; the abrasive portion of the channel allows sculpting or scuffing of the sides of the pool cue tip; the body member also includes a burnishing member which can be rotated around the sides of the leather pool cue tip to burnish the sides.

The method of the invention includes the steps of first positioning the cue shaft in the channel and then rotating an abrasive area around the sides of the cue tip without scratching the shaft or ferrule to make the sides of the tip concentric with its center. Secondly, the sides of the tip are burnished by rotating a concave shaped channel around the sides of the tip to harden the sides. Third, an abrasive is applied in a rotating manner to the top surface of the tip to shape it to an appropriate convex shape. Fourth, the top of the tip is perforated with teeth means to facilitate improved chalk holding capability for the tip.

The means and the method present a comprehensive system for conditioning and maintaining a leather pool cue tip. It can be seen that the invention achieves at least all of its stated objectives.

DETAILED DESCRIPTION OF THE PREFERRED EMBODIMENT

Figure 1:
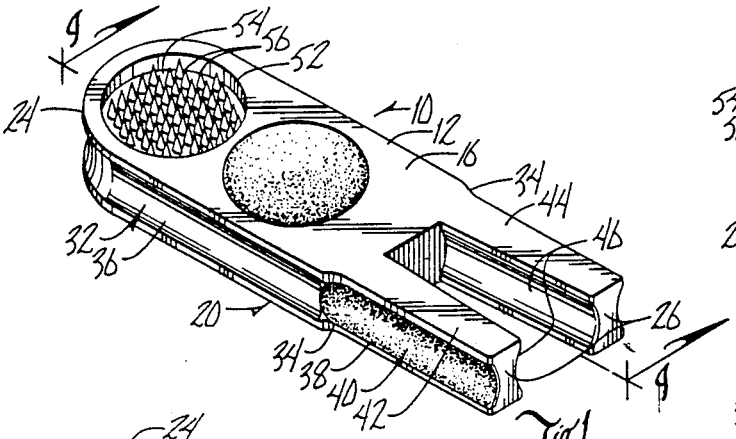
FIG. 1 is a perspective view of a preferred embodiment of the invention.

To assist in a more complete understanding of the invention, a preferred embodiment of the present invention will now be described in detail. It is to be understood that this description discusses one form the invention can take, and is not inclusive of the forms and embodiments it can take.

This description will be made in association with the drawings. Reference numbers are used in the drawings to indicate specific parts and locations. The same reference numerals will be used for the same parts and locations in all the drawings, unless otherwise noted.

By referring to FIG. 1, a pool cue tip tool 10, in accordance with the invention, is depicted. Tool 10 includes a one-piece body 12. In this preferred embodiment, body 12 is elongated along axis 14, and has a top side 16, bottom side 18, edge 20, edge 22, end 24, and end 26.

It is to be understood that in the preferred embodiment, the length of tool 10 along axis 14 is approximately 3 inches; with its width being approximately 1 inch, and thickness $\frac{3}{8}$ of an inch. It is therefore very portable, easily maneuverable, and economical. It is preferably made of aluminum allowing it to be easily mass produced, yet rigid and durable. Tool 10 is utilized to be moved relative to a pool cue leather tip to condition and maintain the tip. The specifics of the functions of tool 10 will be described with respect to the remaining drawings.

Figure 2:
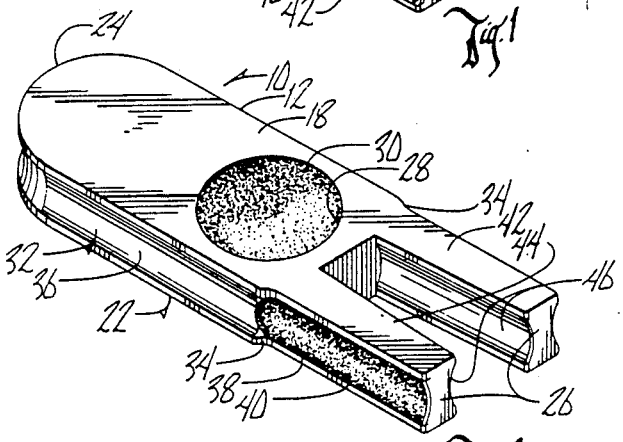
FIG. 2 is a perspective view from an opposite side of FIG. 1.

FIG. 2 depicts a concave cavity 28 on bottom side 18. Concave cavity 28 is approximately 13/16 of an inch in diameter and 3/16 of an inch deep. It is coated with a 40 grit abrasive 30.

Each edge 20 and 22 of body 12 has a concave in cross section channel 32 extending along its length. A step 34 divides first and second portions 36 and 38 of channel 32. Portions 38 are closer to access 14 than portions 36. They are also coated with a 120 grit abrasive 40.

Body 12 also has two generally parallel legs 42 and 44 comprising end 26 of body 12. The outer sides of legs 42 and 44 consist of portions 38 of concave channels 32. The inside sides of legs 42 and 44 also have concave channels 46. These channels 46, however, converge at a 3 degree taper (see FIG. 3).

Figure 3:
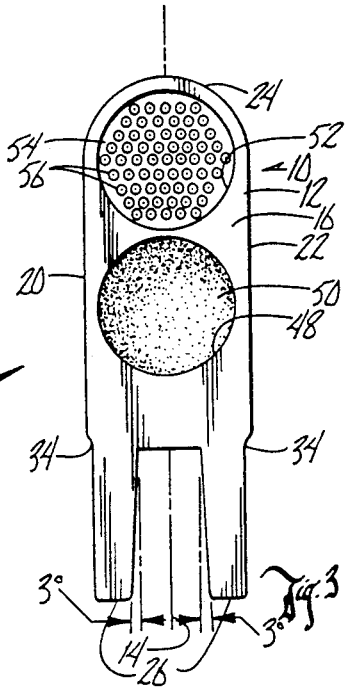
FIG. 3 is a top plan view of FIG. 1.

FIG. 3 shows concave cavity 48 in top surface 16 of body 12. Cavity 48 is approximately 3/16 inches in diameter but is deeper than cavity 28; on the order of $\frac{1}{4}$ inch deep. It is coated with a 120 grit abrasive 50. A cylindrical cavity 52 also exists on top surface 16 of body 12. It is also approximately 3/16 inch in diameter. However, it receives and retains a file steel insert 54 and is secured and positioned by press-fitting, as is well known or other means known within the art. Insert 54 securely is retained within cavity 52 and is approximately 3/10 of an inch in thickness, including rasp-like sharp topped teeth 56. Teeth 56 are spaced apart in one direction but approximately 0.092 inches, and in a perpendicular direction approximately 0.080 inches. It is noted that cavity 48 and cavity 52 are adjacent but spaced apart generally along axis 14 of body 12. Cavity 28, on bottom side 18, is also aligned along axis 14, but is spaced near legs 42 and 44. This allows cavity 28 to be machined deeper through the thickness of body 12 without interfering with cavity 48 on the top surface.

FIGS. 4–7 illustrate more specific details of the body 12 of tool 10. It is to be understood that the diameter of cavities 28, 48, and 52, are larger than a cue tip diameter. The width of channels 32 and 46 are configured to match, as closely as possible, the curvature of most pool cue shafts, ferrules and tips.

Figure 4:
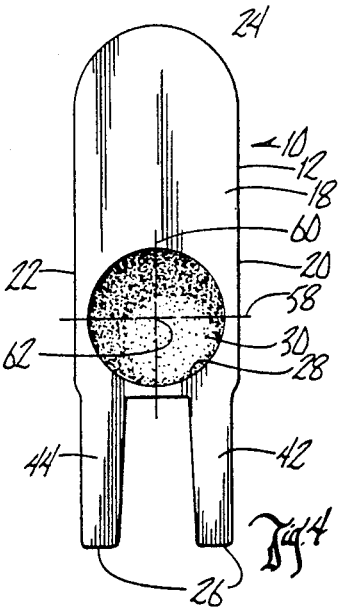
FIG. 4 is a bottom plan view of FIG. 1.

It is pointed out that in FIG. 4, perpendicular dashed lines 58 and 60 intersect at center 62 of cavity 28. It will be appreciated that pool cue tip can be centered at center 62 of cavity 28 rather easily, which is helpful when using tool 10.

Figure 5:
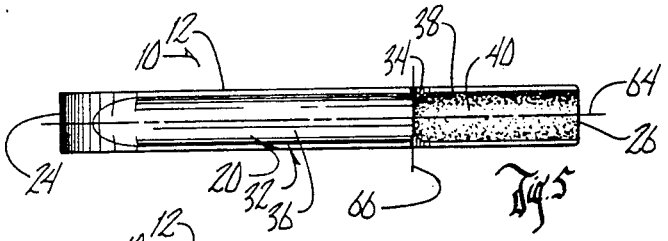
FIG. 5 is a side elevational view of FIG. 1.

In FIG. 5, lines 64 and 66 depict perpendicular axes. Line 66 is centered in channel 32. This illustrates how a pool cue and tip can be easily centered and maintained in a centered position along channel 32.

Figure 6:
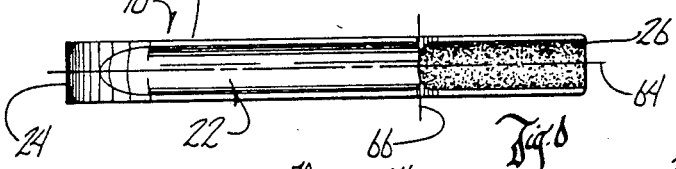
FIG. 6 is an opposite side elevational view of FIG. 1.

FIG. 6 shows channel 38 of leg 44. It is to be understood it also includes abrasive 40, but the abrasive can differ in coarseness if desired.

Figure 7:
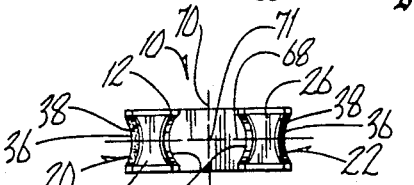
FIG. 7 is an end view of FIG. 1.

FIG. 7 illustrates perpendicular axes lines 68 and 70. These lines intersect at center 71. The concave relationship of channel 46 also generally follow the curvature of a conventional pool cue tip, and basically would be able to cradle the tip to assist in keeping it in an appropriate relationship during use of tool 10.

Figure 8:
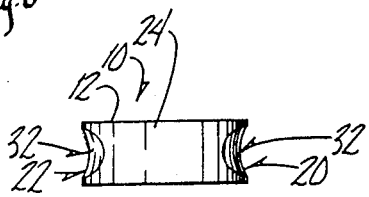
FIG. 8 is an opposite end view of FIG. 1.

FIG. 8 simply shows end 24 of tool body 12, and illustrates how channels 32 extend and disappear into the curved top end 24.

Figure 9:
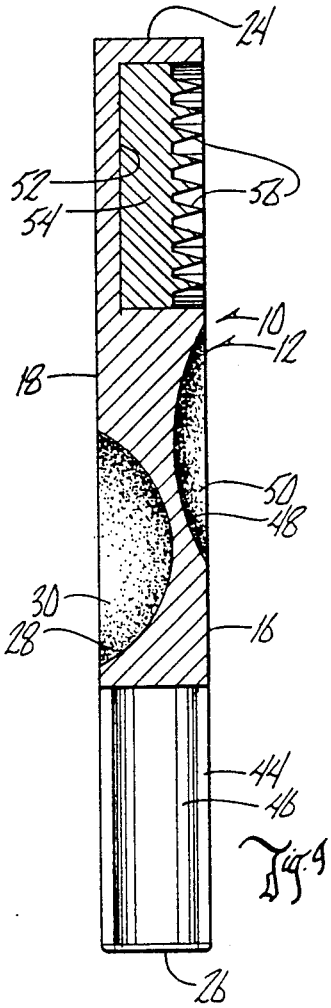
FIG. 9 is a sectional view taken along line 9—9 of FIG. 1.

The method of operation according to the preferred embodiment of the invention described above, is depicted in remaining FIGS. 9–16. FIG. 9 shows a cross-sectional view of cavities 28, 48, and 52. It is to be understood that abrasives 30 and 50 can be adhered to cavities 28 and 48 by means well known within the art including any number of adhesives (e.g. epoxy) which can reliably and durably adhere grit abrasives to aluminum.

Insert 54 can be made of steel or other materials, and can be press-fit into cavity 48. It is to be noted that teeth 56 should not extend above the top surface 16 of body 12, to protect the user from teeth 56.

Figure 10:
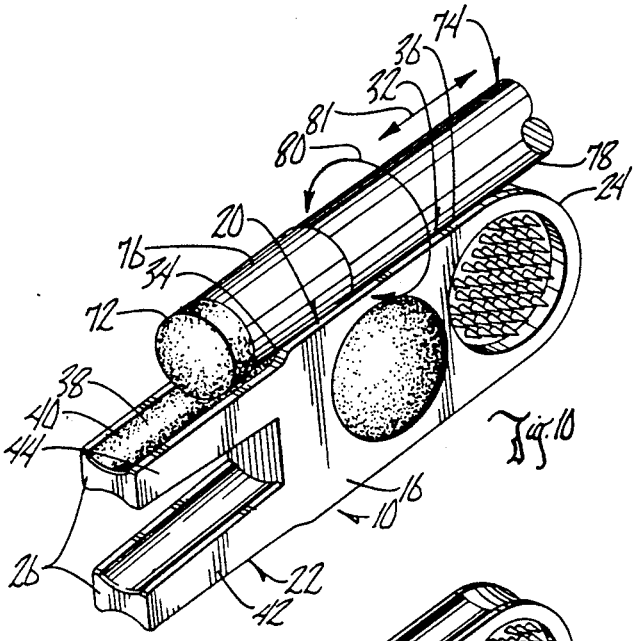
FIG. 10 is a perspective view of the invention showing a pool cue tip being conditioned.

FIG. 10 illustrates a first step for conditioning and maintaining the leather tip 72 secured to pool cue 74. Shaft 78 of cue 74 is laid within portion 36 of either channel 32 of body 12. Step 34 indicates the small drop down to portion 38. As shown by lines 80 and 81 in FIG. 10, cue 78 is then rotated and slid axially in channel 36 so that abrasive 40 cuts away at tip 72. This will sand the sides of tip 72 until the abrasive no longer cuts. This will leave tip 72 slightly larger than ferrule 76 but perfectly centered in concentric around the center of tip 72. The ability to visually see step 34 as well as the small step-down to abrasive 40 allows the user to avoid scratching ferrule 76 or shaft 78 and provide a uniform side wall of tip 72. Light pressure is applied towards tip 72 when rotating and sliding shaft 78. Alternatively, tool 10 can be moved around tip 72.

Figure 11:
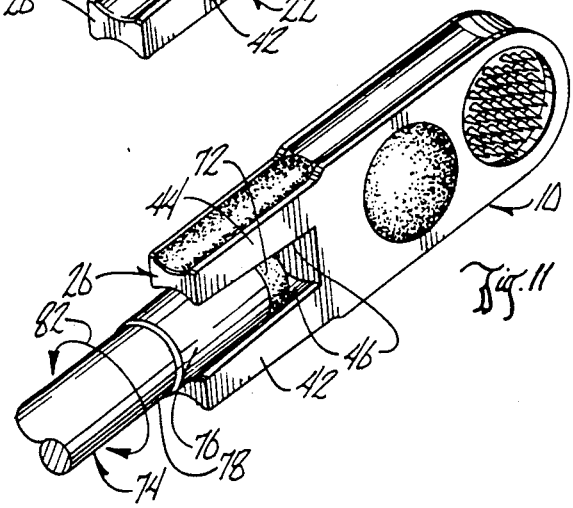
FIG. 11 is a perspective view of the invention showing a pool cue tip being conditioned in a different manner.

FIG. 11 shows that a second operation is the insertion of tip 72 between legs 42 and 44 of tool body 12. Prior to doing so, it is preferred that tip 72 be slightly moistened on its sides. One method of doing so is to wet one's fingers and then apply that moisture around the side of tip 72. The opposite edges of channels 46 are fairly sharp. Tip 72 is inserted between legs 42 and 44 and tool 10 is rotated using light to moderate pressure. The taper will cause legs 42 and 44 to burnish the side of tip 72 around its circumference. Tool 10 should be rotated until side of tip 72 is smooth, shiny, and flush with ferrule 76. Taper between legs 42 and 44 will also give a slight taper to the side wall of tip 72. The smoothing and burnishing will harden the side wall and slow mushrooming of the leather. Line 82 shows the rotational movement of tool 10 to burnish tip 72.

Figure 12:
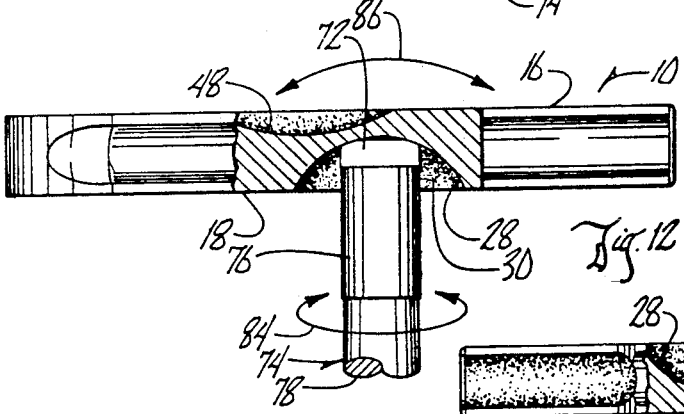
FIGS. 12–14 are cut away depictions of the embodiment of FIG. 1 utilized in conditioning and maintaining a pool cue tip.
Figure 13:
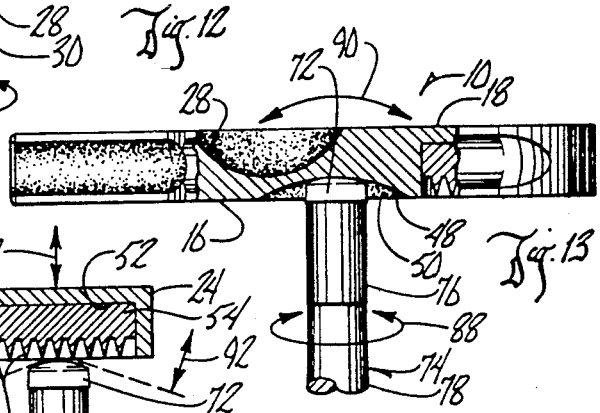

FIG. 12 shows an additional step. The butt of shaft 78 is placed on the floor and then cavity 28, with its 120 grit abrasive, is placed on tip 72 so that tool 10 is generally perpendicular to shaft 78. Cavity 28 and abrasive 30 will be called the shaping recess for tool 10. Cue shaft 78 is then rotated in the directions of line 84 in FIG. 13, while at the same time tool 10 is rocked back and forth in the directions of line 86 using moderate pressure. Leather should be removed from tip 72 until all but the center ¼ inch diameter of tip 72 has been cut. The curvature of cavity 28 is such that it will automatically create an appropriate radius similar to the radius of a nickel, which is one preferred radius or convex curvature of across the top of tip 72. Other shapes are possible or desired.

Another step (FIG. 13) that can be accomplished with tool 10 is to turn tool 10 over and place cavity 48, with abrasive 50, onto tip 72. Tip 72 can be lightly chalked prior to this, if desired. Cavity and abrasive 48, 50 will be called the scuffer recess for tool 10. As shown by lines 88 and 90, shaft 78 is again rotated back and forth while tool 10 is rocked across tip 72. The abrasive 50 is allowed to scuff the leather tip 72 until all chalk is removed from the tip except for an area about the size of a pencil eraser at its center. An area about twice this diameter may be desired prior to using the cue for a break to begin a pool game.

Figure 14:
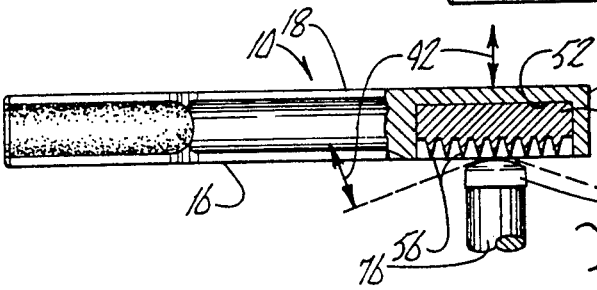

FIG. 14 shows an additional step available with tool 10. Teeth 56 of insert 54 are lightly tapped on tip 72 by the movement shown by lines 92 in FIG. 16. Teeth 56 should be tapped over the entire surface of tip 72 to lightly perforate tip 72 to better hold chalk. The tapping should be light so that it does not materially change the shape of tip 72.

It is preferred that the steps described above be completed in the order presented. The invention allows the quick and easy completion of these steps and therefore presents the tip in a well conditioned and maintained state. As is obvious, however, only selected steps might be utilized as desired.

It will be appreciated that the present invention can take many forms and embodiments. The true essence and spirit of this invention are defined in the appended claims and is not intended that the embodiment of the invention presented herein should limit the scope thereof.

For example, different shapes and configurations of tool 10 can be configured and stay within the boundaries of the invention. Tool 10 can be made of a variety of different materials and the types of abrasives or sizings or dimensions of components of the tool can change according to need or desire.

By still further example, only one channel 32 may be necessary for the invention. Still further, only one leg 42 or 44 may be required.

Still further it is to be understood that tool 10 can be colored or painted, and descriptive indicia or instructions could be included on the tool body itself.

What is claimed is:

1. A pool cur tip tool comprising:

an elongated tool body, said body having an elongated central axis;

a tip trimming means for trimming and sanding the side wall of the tip;

a tip burnishing means at one end of said body for burnishing the side wall of the tip, said burnishing means being a pair of generally parallel, spaced apart legs, each of said legs defining a passage therebetween for receiving and burnishing the tip of a pool cue stick;

a first tip shaping means for coarsely shaping the top of the tip;

a second tip shaping means for more finely shaping the top of the tip; and a tip perforator means 26 for perforating the tip to better hold chalk.

2. The tool of claim 1 wherein the tip trimming means comprises a concave channel on at least one side, one portion of the channel edge of said tool body including an abrasive means.

3. A pool cue tool comprising:

a frame having opposite top and bottom sides, opposite side walls between the opposite top and bottom sides, and opposite ends;

at least one concave cavity in one of the top and bottom sides, abrasive means secured in the cavity;

teeth means within a recess in one of the top and bottom sides;

a groove along one of the side walls, the groove including abrasive means secured along a portion of the groove; and a burnishing means for burnishing the side wall of a cue tip at one end of the frame, so that said tool can be utilized to selectively shape, burnish, or perforate a pool cue tip.

4. The pool cue tool of claim 3 wherein the burnishing means comprises two generally parallel legs extending from one of said frame ends adjacent surfaces of the legs having concave channels which conversionally taper towards one another.

5. The pool cue tool of claim 3 wherein said groove in one of said side walls has a first portion which is raised from a second portion, the second portion containing the abrasive.

6. The pool cue tool of claim 3 further comprising a second concave cavity in one of the top or bottom sides of the frame, said cavity having an abrasive means therein.

7. The pool cue tool of claim 3 wherein said teeth means is an insert insertable into a cavity in the frame, the insert being made of a material different from the frame.

8. The pool cue tool of claim 3 wherein said at least one cavity is approximately 13/16 of an inch in diameter.

9. The pool cue tool of claim 3 wherein said body is made of aluminum.

10. The pool cue tool of claim 3 wherein the abrasive means is a grit abrasive.

* * * * *

UNITED STATES PATENT AND TRADEMARK OFFICE

CERTIFICATE OF CORRECTION

PATENT NO. : 5,104,122

DATED : April 14, 1992

INVENTOR(S) : David L. Gossman

It is certified that error appears in the above—identified patent and that said Letters Patent is hereby corrected as shown below:

In claim 1, column 6, line 47, please delete [cur]

and substitute --cue--.

Signed and Sealed this

Fourteenth Day of September, 1993

Bruce Lehman

*Attest:*

BRUCE LEHMAN

*Attesting Officer*

*Commissioner of Patents and Trademarks*